US012680306B2

(12) United States Patent
Schiøtt Johannsen

(10) Patent No.: US 12,680,306 B2
(45) Date of Patent: Jul. 14, 2026

(54) GUTTER SYSTEM AND A METHOD OF ASSEMBLING A GUTTER SYSTEM

(71) Applicant: INNOMONDO APS, Frederiksberg (DK)

(72) Inventor: Berit Jane Schiøtt Johannsen, Frederiksberg (DK)

(73) Assignee: Tinghoff Invest Ltd, London (GB)

( * ) Notice: Subject to any disclaimer, the term of this patent is extended or adjusted under 35 U.S.C. 154(b) by 242 days.

(21) Appl. No.: 18/720,444

(22) PCT Filed: Dec. 16, 2022

(86) PCT No.: PCT/EP2022/086367
§ 371 (c)(1),
(2) Date: Jun. 14, 2024

(87) PCT Pub. No.: WO2023/111275
PCT Pub. Date: Jun. 22, 2023

(65) Prior Publication Data

US 2025/0059768 A1 Feb. 20, 2025

(30) Foreign Application Priority Data

Dec. 17, 2021 (DK) ..... PA 2021 70632

(51) Int. Cl.
*E04D 13/068* (2006.01)

(52) U.S. Cl.
CPC ..... *E04D 13/0685* (2013.01)

(58) Field of Classification Search
CPC ..... E04D 13/0685; E04D 13/068
See application file for complete search history.

(56) References Cited

U.S. PATENT DOCUMENTS 4,305,236 A * 12/1981 Williams ..... E04D 13/0685 248/48.1
4,954,015 A * 9/1990 McGowan ..... E04D 13/068 52/11

(Continued)

FOREIGN PATENT DOCUMENTS

DK 126699 B 8/1973
EP 1881126 A2 * 1/2008 ..... E04D 13/068

(Continued)

OTHER PUBLICATIONS

Danish Patent and Trademark Office, Search Report in Danish Patent Application No. PA 2021 70632, dated Mar. 15, 2022 (6 pages).

(Continued)

*Primary Examiner* — Rodney Mintz
(74) *Attorney, Agent, or Firm* — Nixon Peabody LLP

(57) ABSTRACT

A gutter system comprising a number of gutter sections with a convex outer surface and gutter fittings with a concave inner surface adapted for receiving and fixing the open end of two gutter sections so that the convex outer surface of each gutter section rest against the concave inner surface of the gutter fitting, and where the gutter fitting comprises one or more indentations arranged in the concave inner surface and the gutter section comprises one or more projections arranged on the convex outer surface of the gutter trough, and where the one or more indentations and the one or more projections are adapted so that the one or more projections can be inserted into the one or more indentations with a snap fit.

12 Claims, 2 Drawing Sheets

(56) References Cited

U.S. PATENT DOCUMENTS

Figure 1:
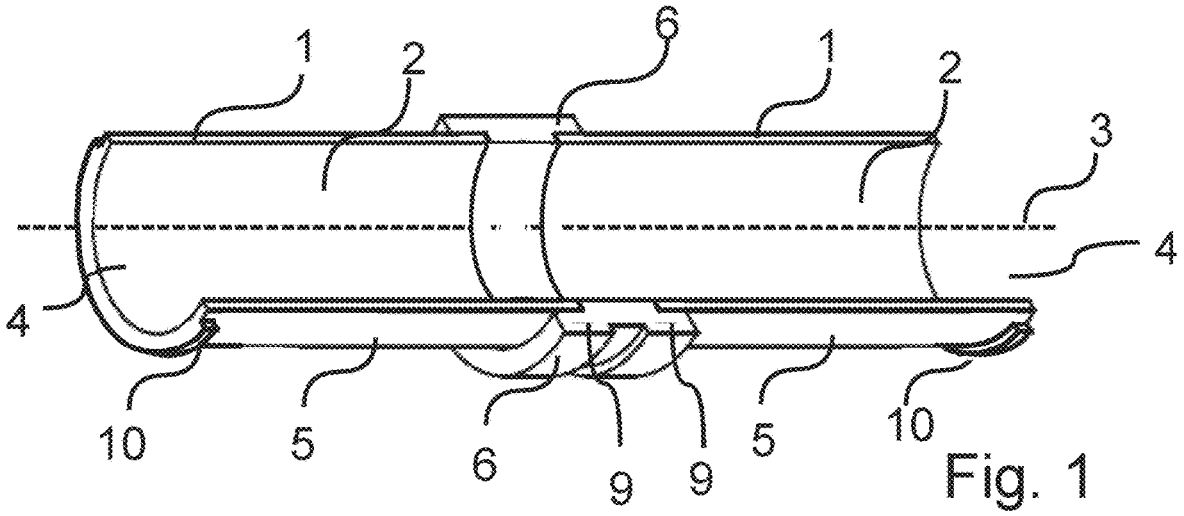

| | | | | |
|---|---|---|---|---|
| 5,035,092 | A * | 7/1991 | Brant | E04D 13/068 52/12 |
| 5,038,528 | A * | 8/1991 | Brant | E04D 13/068 248/48.1 |
| 5,687,510 | A * | 11/1997 | Basista | E04D 13/068 403/301 |
| 7,076,921 | B2 * | 7/2006 | Spradlin | E04D 13/0641 248/48.1 |
| 7,610,722 | B1 * | 11/2009 | Carroll | E04D 13/0643 52/12 |
| 8,322,082 | B2 * | 12/2012 | Neumann | E04D 13/076 52/12 |
| 10,190,319 | B1 * | 1/2019 | Mongelluzzo | E04D 13/076 |
| 10,526,788 | B2 * | 1/2020 | Mongelluzzo | E04D 13/0765 |
| 11,313,128 | B2 * | 4/2022 | Mongelluzzo | F21S 4/28 |
| 12,371,907 | B2 * | 7/2025 | Mongelluzzo | E04D 13/076 |
| 2005/0016076 | A1 * | 1/2005 | Spradlin | E04D 13/0641 52/11 |
| 2011/0138698 | A1 * | 6/2011 | Neumann | E04D 13/076 52/12 |
| 2019/0010704 | A1 * | 1/2019 | Mongelluzzo | F21S 9/032 |
| 2019/0010705 | A1 * | 1/2019 | Mongelluzzo | E04D 13/0765 |
| 2019/0153731 | A1 * | 5/2019 | Mongelluzzo | F21V 33/006 |
| 2020/0256059 | A1 * | 8/2020 | Mongelluzzo | E04D 13/0765 |
| 2023/0030131 | A1 * | 2/2023 | Mongelluzzo | F21V 33/006 |
| 2023/0235561 | A1 * | 7/2023 | Mongelluzzo | E04D 13/0765 52/12 |

FOREIGN PATENT DOCUMENTS

| | | | |
|---|---|---|---|
| GB | 1244968 | A | 9/1971 |
| GB | 1304526 | A | 1/1973 |
| GB | 1603818 | A | 12/1981 |
| GB | 2185502 | A | 7/1987 |
| GB | 1026542 | A | 4/1996 |
| GB | 2394728 | A | 5/2004 |

OTHER PUBLICATIONS

International Search Report and Written Opinion of International Searching Authority for Application No. PCT/EP2022/086367, mailed Apr. 17, 2023 (8 pages).

* cited by examiner

GUTTER SYSTEM AND A METHOD OF ASSEMBLING A GUTTER SYSTEM

CROSS-REFERENCE TO RELATED APPLICATIONS

This application is a U.S. National Stage of International Application No. PCT/EP2022/086367, filed Dec. 16, 2022, which claims the benefit of and priority to Denmark Patent Application No. PA 2021 70632, filed Dec. 17, 2021, both of which are incorporated herein by reference in their respective entireties.

THE PRIOR ART

The present invention relates to a gutter system comprising a number of gutter sections and gutter fittings, and where a gutter section comprises a gutter trough extending along a longitudinal axis with at least one open end with a convex outer surface and where a gutter fitting have a concave inner surface and is adapted for receiving and fixing the open end of two gutter sections so that the convex outer surface of each gutter section rest against the concave inner surface of the gutter fitting.

Gutter systems are well known in many different embodiments providing the user to assemble a gutter adapted for any type of building and for this purpose such gutter systems typically comprises a number of long slender gutter sections forming the dewatering troughs of the finished, and a number of gutter fittings forming e.g. gutter end caps, gutter corners, gutter brackets, gutter unions or gutter outlets.

GB patent application number 2394728 discloses a gutter system as mentioned in the introduction adapted for easy assembly of gutter sections to a gutter fitting.

THE OBJECT OF THE INVENTION

On this background, it is the purpose of the present invention to provide a gutter system being easy to assemble and providing a tight and secure assembly using relatively few separate components.

This is obtained by the invention according to claim 1 specifying that the gutter fitting comprises one or more indentations arranged in the concave inner surface and the gutter section comprises one or more projections arranged on the convex outer surface of the gutter trough, and where the one or more indentations and the one or more projections are adapted so that the one or more projections can be inserted into the one or more indentations with a snap fit.

In a preferred embodiment the at least one indentation forms a groove adapted so that the one or more projections engages with the groove with a snap fit.

Furthermore at least one of the projections is formed as a ridge.

The groove may preferably extend substantially perpendicular to the longitudinal axis.

In a preferred embodiment the groove may comprise an end stop arranged at both of its ends and the length of one groove corresponds to the length of the ridge so that each of the opposite ends of the ridge abuts one end stop of the groove such that the ridge can only be released from and/or inserted into the grove by elastic deformation of the gutter fitting and/or the gutter trough.

The gutter fitting may advantageously comprise two grooves arranged mutually parallel with a distance between them.

In a preferred embodiment, the gutter section is open and comprises projections arranged at both ends.

The gutter fitting may comprise a bracket part adapted for attaching the gutter fitting to a supporting structure.

In a preferred embodiment, the gutter section is made from a thermoplastic material.

In this relation, the projections may be formed integrally with the gutter section, e.g. by molding.

The invention also relates to a method of assembling a gutter using a gutter fitting and two gutter sections according to any of the preceding claims, wherein each projection on each gutter section is first arranged in front of an indentation on the gutter fitting, and thereafter pressing the projection into a snap engagement in the indentation.

In this relation, the gutter section may preferably be provided from cutting a section of a longer gutter profile made from a thermoplastic material and thereafter inserting an end of the section into a mold adapted for melting and reshaping the plastic material at the end of the section to form the one or more projections.

THE DRAWING

In the following, one or more embodiments of the invention will be described in more detail and with reference to the drawing, where:

FIG. 1: Is a perspective drawing showing a gutter assembled using components according to the present invention.

Figure 2:
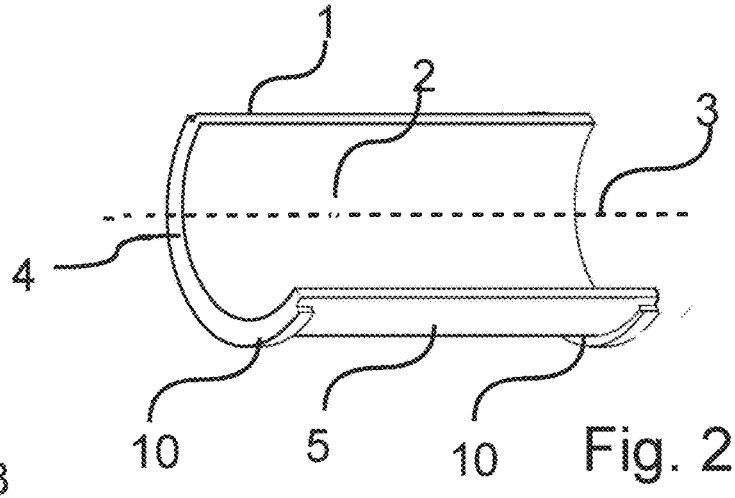

FIG. 2: Is a perspective drawing showing one embodiment of a gutter section according to the invention and as shown in FIG. 1.

Figure 3:
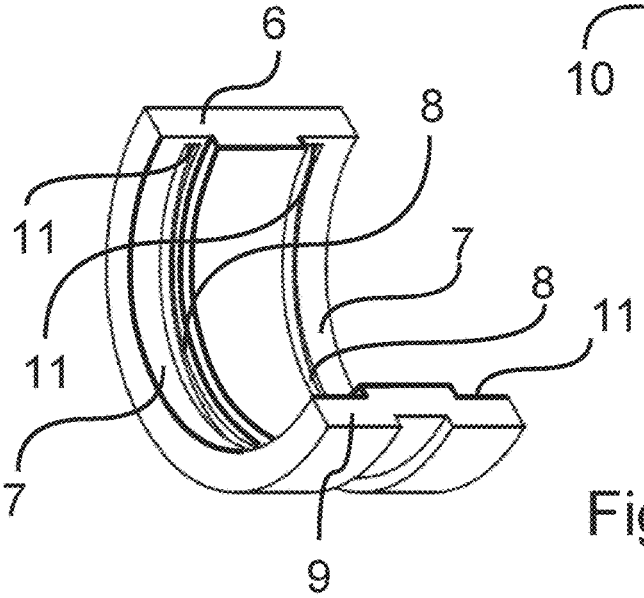

FIG. 3: Is a perspective drawing showing one embodiment of a gutter fitting according to the invention, and as shown in FIG. 1.

Figure 4:
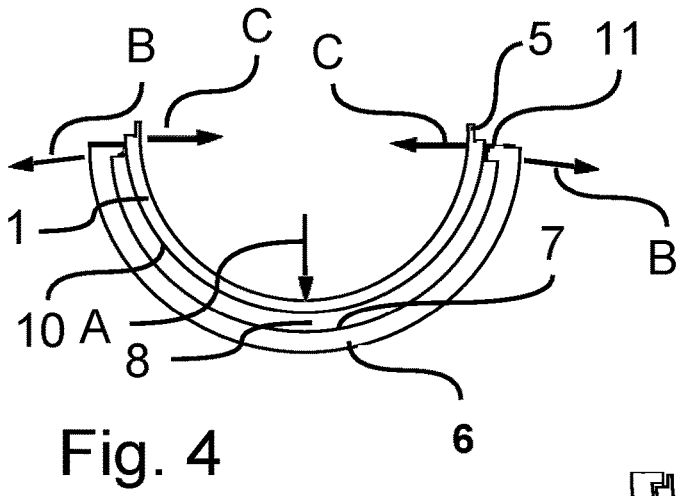
Figure 5:
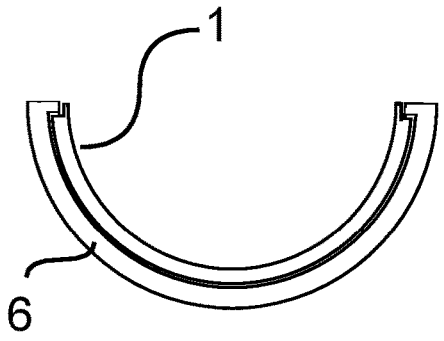

FIGS. 4 and 5: Are cross section drawings showing the process of assembling a gutter section with a gutter fitting as shown in FIGS. 1, 2 and 3 before and after assembly.

Figure 6:
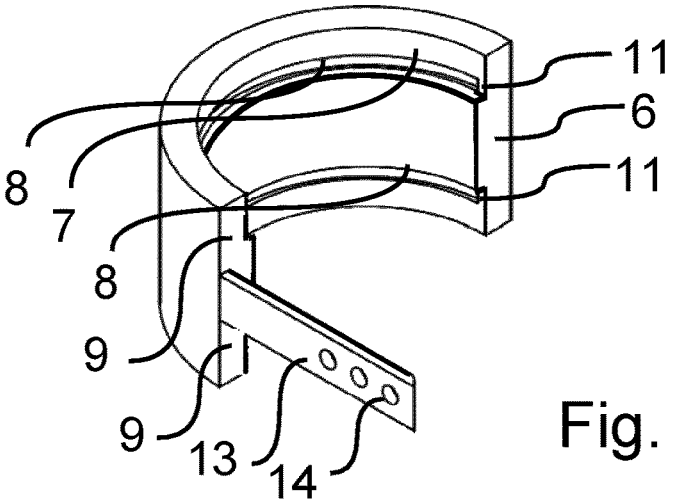

FIG. 6 is a perspective drawing showing a second embodiment of the gutter fitting according to the invention.

DESCRIPTION OF EXEMPLARY EMBODIMENTS

FIG. 1 shows an embodiment of a gutter assembly according to the invention using two gutter sections 1 as shown in FIG. 2 and one gutter fitting 6 formed as a gutter union as shown in FIG. 3. For illustrative purpose this embodiment thereby only shows a part of a complete gutter assembly e.g. adapted for a specific building and it will be apparent for the skilled person that a complete gutter assembly may be assembled using multiple gutter sections 1 and gutter unions 6. Furthermore, it will be apparent that the gutter sections may vary in length and design, such as the gutter segments shown in FIGS. 4 and 5, without thereby departing form the teaching of the present invention.

The gutter segments may also comprise gutter segments forming gutter corners or gutter outlets.

As shown in FIG. 3 the gutter fitting 6 have a concave inner surface 7 adapted for receiving and fixing an outer convex surface 5 near the open end 4 of each of the two gutter sections 1 so that the two gutter sections 1 in FIG. 1 extend in each other's prolongation along a common longitudinal axis 3 and thereby the two gutter sections together forms a single gutter trough 2.

In order to hold the two gutter sections 1 in place in the gutter fitting the gutter fitting have two parallel grooves 8 each having and end stop 11 and an opening 9 at one end, and the gutter sections 1 have projections 10 formed as ridges or flanges with a cross section corresponding to the cross section of the grooves 8, so that each of the gutter sections 1 can be mounted on the gutter fitting 6 by first arranging one of the projections 10 in front of a groove 8 on the gutter fitting 6, and then pressing the projection 10 of the gutter section 1 into a groove 8 until the projection 10 it is locked into an interlocking engagement with the groove 8 with a snap.

In this relation FIGS. 4 and 5 shows process of assembling the gutter section with a gutter fitting as shown in the previous figures with a snap engagement. FIG. 4 shows a cross section of the gutter section with the projection 10 formed as a ridge or flange before it is pressed into the groove 11 of the gutter fitting by providing a force as shown with the arrow A. Thereby the opposite sides of the gutter fitting 6 with the end stops 11 are flexing away from each other as shown with the arrows B and/or the opposite side edges of the gutter section 1 are flexing against each other as shown with the arrows C.

When the projection 10 formed as a ridge or flange is completely entered into the groove 11 as shown in FIG. 5, then the end stops 11 snaps back into the original position and the projection is locked between the end stops 11.

In the embodiments shown in the drawings the gutter fitting have a single continuous groove 8 adapted for assembling each gutter section, and the projection 10 is shaped as a continuous flange or ridge, but it will be apparent to the skilled person that the snap functionality may be obtained in various other ways using two or more projections 10 and grooves 8 as long as they provide the function of allowing the projections 10 to be snapped into the grooves 8.

In this embodiment the grooves 8 on the gutter fitting 6 is provided end stops 11 near the opposite sides of the groove 8.

FIG. 4 shows an another embodiment of a gutter segment 1 where the gutter segment 1 is a tube provided with holes on one side FIG. 6 shows an alternative embodiment of a gutter fitting 6 where the gutter fitting further comprises a bracket part 13 with screw holes 14 so that the gutter fitting form a gutter bracket adapted for being mounted onto a supporting structure (not shown 9. Apart from that the gutter bracket in FIG. 6 can be comprises grooves 8 arranged in the same manner as the grooves 8 on the gutter fitting shown in FIG. 3, and thereby the gutter bracket shown in FIG. 6 can be assembled with any of the gutter sections shown in FIG. 2, 4 or 5.

The invention claimed is:

1. A gutter system comprising:

a plurality of gutter sections and a plurality of gutter fittings, wherein each gutter section comprises a gutter trough extending along a longitudinal axis with at least one open end having a convex outer surface and each gutter fitting having a concave inner surface configured for receiving and fixing the open end of two said gutter sections so that the convex outer surface of each gutter section rests against the concave inner surface of a respective said gutter fitting, and wherein the gutter fittings comprise one or more indentations arranged in the concave inner surface and the gutter sections comprise one or more projections arranged on the convex outer surface of the gutter trough, and the one or more indentations and the one or more projections are configured so that the one or more projections are inserted into the one or more indentations with a snap fit connection.

2. The gutter system according to claim 1, wherein one of the projections is a ridge.

3. The gutter system according to claim 1, wherein the gutter fittings comprise two grooves arranged mutually parallel with a distance therebetween.

4. The gutter system according to claim 1, wherein each gutter section is open and comprises projections arranged at distal ends thereof.

5. The gutter system according to claim 1, wherein the gutter fittings comprise a bracket part adapted for attaching the gutter fittings to a supporting structure.

6. The gutter system according to claim 1, wherein each gutter section is made from a thermoplastic material.

7. The gutter system according to claim 6, wherein the projections are formed integrally with the gutter sections by molding.

8. The gutter system according to claim 1, wherein at least one said indentation forms a groove adapted so that the one or more projections engages with the groove by way of the snap fit connection.

9. The gutter system according to claim 8, wherein the groove extends substantially perpendicular to the longitudinal axis.

10. The gutter system according to claim 8, wherein the groove comprises an end stop arranged at distal ends of the groove and a length of the groove corresponds to a length of the projections so that opposite ends of the ridge abuts the end stop of the groove such that the projections are only released from or inserted into the grove by elastic deformation of the gutter fittings or the gutter trough.

11. A method of assembling the gutter system according to claim 1, the method comprising:

arranging each projection on each gutter section in front of a respective said indentation on the respective gutter fitting, and pressing each projection into a snap engagement in the respective indentation.

12. The method according to claim 11, wherein each gutter section is provided from cutting a respective section of a longer gutter profile made from a thermoplastic material and thereafter inserting an end of the respective section into a mold adapted for melting and reshaping the thermoplastic material at the end of the respective section to form the one or more projections.

* * * * *